United States Patent [19]

Schellenberg

[11] 3,966,114

[45] June 29, 1976

[54] BOX WITH A MEMBRANE WHICH SEALS THE BOX

[75] Inventor: Walter Schellenberg, Diepoldsau, Switzerland

[73] Assignee: Max Sandherr AG, Diepoldsau, Switzerland

[22] Filed: June 2, 1975

[21] Appl. No.: 582,817

[30] Foreign Application Priority Data

July 22, 1974 Switzerland ..... 10089/74

[52] U.S. Cl. ..... 229/51 CE; 220/258; 220/280

[51] Int. Cl.[2] ..... B65D 17/20; B65D 5/54

[58] Field of Search ..... 220/279, 280, 219, 254, 220/258, 265, 269, 270; 229/51 CE, 51 ST, 51 R; 206/498; 248/272

[56] References Cited

UNITED STATES PATENTS

| | | | |
|---|---|---|---|
| 563,936 | 7/1896 | Merriam | 220/280 |
| 1,884,613 | 10/1932 | Dister | 220/258 |
| 2,111,566 | 3/1938 | Link | 220/258 X |
| 2,330,878 | 10/1943 | Foley | 229/51 R |
| 3,537,610 | 11/1970 | Biloh | 220/258 |
| 3,542,236 | 11/1970 | Dru | 220/258 |

FOREIGN PATENTS OR APPLICATIONS

| | | | |
|---|---|---|---|
| 404,026 | 1/1934 | United Kingdom | 229/51 CE |

*Primary Examiner*—Davis T. Moorhead
*Attorney, Agent, or Firm*—Roylance, Abrams, Berdo & Kaul

[57] ABSTRACT

A rupturable seal for a container of the type having an insertable lid wherein the seal constitutes a membrane having a cylindrical portion extending into the open end of the container to beyond the insertion depth of the lid, the upper edge of the cylindrical portion being adhered to the inner surface of the container, the seal having a transverse portion extending across the interior of the container to close it. A tear strip surrounds the cylindrical portion between it and the inner surface of the container and protrudes through an opening in the cylindrical portion to form a holding flap which can be pulled, after the lid is removed, to rupture the membrane which is then removed. An upper portion of the membrane wraps over the open edge of the box to form a protective covering therefor which remains. In an alternative embodiment the tear strip extends around the inner surface of the cylindrical portion and is adhered thereto. The opening through which the holding flap extends can be sealed by adhering overlying ends of the tear strip, or by a sealing patch or foil cover. The membrane can be deep drawn aluminum or a plastic material.

10 Claims, 3 Drawing Figures

BOX WITH A MEMBRANE WHICH SEALS THE BOX

This invention relates to a closure for a container and, more specifically, to a warranty seal for a box of a type having a tear strip.

It is known in the prior art to provide a container such as a box having a lid and an inner membrane so that the lid can be removed and the membrane destroyed by operating a tear strip so that the contents of the box are thereafter available but the box is reclosable by restoring the lid. The membrane is designed so that once it is removed, it cannot be restored.

An example of the prior art is shown in German application DAS 2,061,497. In that disclosure, there is shown a box having a tear-off tongue fixed to a membrane surface as well as an incision provided in the cylindrical portion of the membrane edge along which the membrane is separated from its remaining edge portion after tearing away the tear-off tongue. It has been found that the manufacture of a membrane of this type having a satisfactorily functioning incision is extremely difficult to produce in practice and involves an intolerable degree of technical expenditure to obtain the tolerances necessary. The cut edges in this assembly tend to tear and the edge of the box can be easily deformed.

The object of the present invention is to provide a box having a membrane which can be removed in a simple manner on first opening the box by breaking the warranty seal, indicating no previous pilfering of the box has occurred, without damaging the inner lining of the box.

A further object is to provide a rupturable membrane which can be simply and easily opened and which can be manufactured in a simple manner.

Briefly described, the invention comprises an improved pilfer-proof membrane seal for a container of the type having a replaceable lid insertable into the open end of the container, the seal comprising a membrane having a cylindrical portion extending downwardly into the open end of the container at least to the insertion depth of the lid, the cylindrical portion lying adjacent the inner surface of the container and being at least partly sealed to the inner surface, and a transverse portion extending across the interior of the container to close the interior volume thereof below the insertion depth; and a tear strip extending completely around the inner surface of the container and lying between the cylindrical portion and the inner surface. The cylindrical portion is advantageously formed with a small opening therein and an end of the tear strip extends through the opening to form a holding flap which can be grasped and pulled to rupture the seal. The strip also advantageously extends around the entire inner periphery of the container so that the holding flap end of the strip overlaps the other end thereof. The membrane can extend over the upper edge of the open end of the container to form a protective shield for the container edge with the strip adhered to the cylindrical portion of the membrane. The opening can be sealed with a plastic sealing compound or an adhered piece of foil or the like, and the tear strip can be reinforced with glass fibers. The portion of the membrane which extends over the edge of the open end of the container remains after the tear strip has been pulled and the rest of the seal removed so that the edge protection stays with the container.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
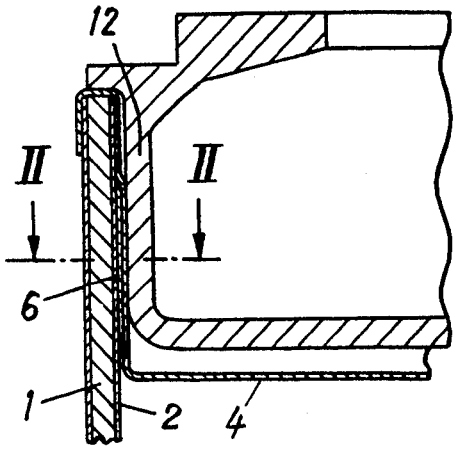
FIG. 1 is a partial elevation, in section, of a container showing the disposition of the seal and lid.

Referring now to the drawings in detail, it will be seen that the container 1 can be manufactured by cutting pieces from a cardboard tube corresponding to the container length, the tube having previously been provided with an inner lining 2 and, optionally, an outer lining 3. The lining or covering 3 can otherwise be applied to the box during a later process as a label.

Membrane 4 can be formed, for example, from aluminum foil by a deep drawing process so that it is provided with a cylindrical inner surface portion 5 with a tear strip 6 surrounding the cylindrical portion on its outer surface. A hot sealing varnish is applied to the outer surface of the cylindrical portion and the exposed surface of the tear strip and the membrane 4 is introduced into the end of the container through its open end and the exposed open edge thereof is flanged over the cut edge 9 of the container to form an edge protection 8 in the manner shown in FIGS. 1 and 3. Thus, following hot sealing, the cylindrical portion 5 of membrane 4 is firmly attached to the interior surface of the container at least in that portion which lies between the tear strip 6 and edge 9 of the container, while the remaining cylindrical portion of the membrane engages in an easily liftable or detachable manner with the inner wall of container 1, for example via tear strip 6. As stated hereinbefore, tear strip 6 is attached to the cylindrical portion such as by sealing or adhering prior to the insertion of the membrane into the box. One end of the tear strip is caused to pass inwardly through the wall of the cylindrical portion 5 by means of a punch and the remaining portion thereof is externally wound around the cylindrical portion.

Figure 2:
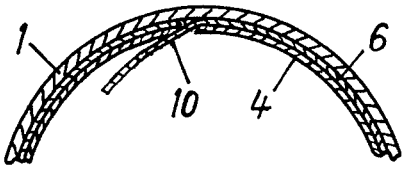
FIG. 2 is a partial plan view, in section, along lines II—II of FIG. 1.
Figure 3:
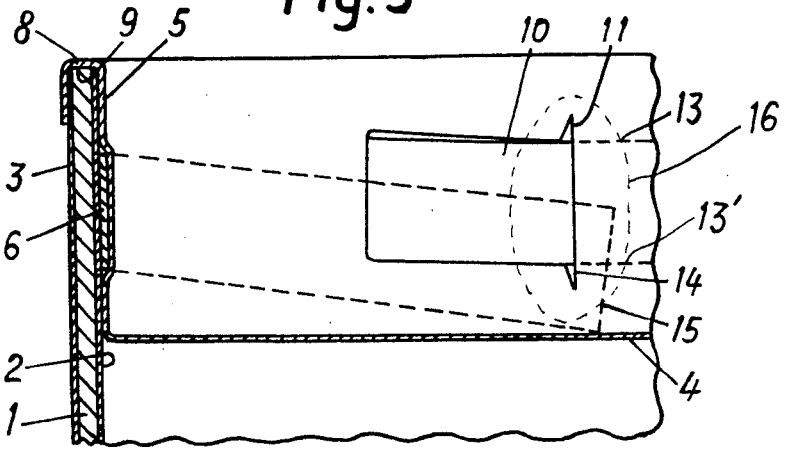
FIG. 3 is a partial elevation, in partial section, showing a container and seal with the lid removed.

As shown in FIG. 2 and 3 an end 10 of the tear strip 6 extends inwardly through the opening 11 in cylindrical portion 5 of the membrane 4 to form a holding flap 10 so that after the insertable lid 12 has been extracted from the box, holding flap 10 can be gripped in the hand and pulled to rupture the membrane.

It will be observed that the transverse sealing portion of membrane 4 closes off the interior volume of the container and is designed so that it extends across the interior volume of the container just below the insertion depth of the lid as determined by the conventional design thereof.

It will be observed that opening 11 extends below the holding flap 10, of necessity, and in situations in which the lower portion of the membrane structure is not sealed to the interior of the box, it is necessary to close this opening so that there will not be deterioration of the contents of the container. To prevent such deterioration, the tear strip can be overlapped upon itself so that the inner end 15 of the strip lies across the inside of that opening. Adhering the membrane to the inner end of the strip in this fashion closes opening 14 to prevent such deterioration by completing the closure of the container. Alternatively, the opening can be closed by a plastic sealing compound such as a small wax plug 16 prior to the membrane being inserted into the box. Alternatively, a small piece of foil or the like can be adhered over the opening in the region indicated at 16.

In the example presented herein, the tear strip 6 is connected with the outside of cylindrical portion 5 of membrane 4. It is, however, possible to provide a tear strip on the inside of the cylindrical portion with the strip firmly adhered to the interior of the membrane so that grasping and pulling the strip overcome the tear strength of the membrane itself so that it pulls the membrane away from the inner surface of the container and accomplishes the necessary rupture. It is, of course, essential in this case that the adherence of the strip be sufficiently strong to insure that tearing will take place.

Although FIG. 2 illustrates the container as having a circular cross-section, it is possible to employ the present invention in boxes or other containers having a non-circular, e.g., rectangular cross-section, and to provide them with a membrane which can be separated by a tear strip in the manner described.

A plastic foil made, for example, from polystyrene, polyvinyl chloride or polypropylene can be used in place of aluminum foil when manufacturing the deep drawn membrane 4. The tear strip can be made from aluminum, paper, plastic and other materials. Advantageously, however, a material is used which undergoes no substantial thermal expansion or deformation at the hot sealing temperature of, for example, 200° C. which, on cooling, could lead to folds in the membrane or the detachment thereof. A polyester strip reinforced with glass fibers is particularly suitable for this purpose. The width of the tear strip can vary and it can, for example, be as thin as a wire or can comprise a wire.

By pulling on the holding flap the cylindrical portion 5 of membrane 4 tears along the path of tear strip 6 or the tearing lines 13–13′ so that the seal portion of membrane 4, usually together with the tear strip, is detached from the remaining membrane portion connected with the box, leaving the edge protective portion 8 attached to the edge of the box, the remaining portions of the membrane and tear strip being removed. Thus, pulling away of lining 2 from box 1 is prevented because the upper cylindrical portion 5 of the membrane is firmly sealed in place and, on resealing, is pressed down again by insertion of lid 12.

While certain advantageous embodiments have been chosen to illustrate the invention, it will be understood by those skilled in the art that various changes and modifications can be made therein without departing from the scope of the invention as defined in the appended claims.

What is claimed is:

1. An improved pilfer-proof membrane seal for a container of the type having a replaceable lid insertable into the container opening, the seal comprising a membrane having a cylindrical portion extending downwardly into the open end of the container at least to the insertion depth of the lid, said cylindrical portion lying adjacent the inner surface of the container and being at least partly sealed to said inner surface, and a transverse portion extending across the interior of said container to close the interior volume thereof below said insertion depth; and a tear strip extending completely around the inner surface of said container and lying between said cylindrical portion and said inner surface.

2. A seal according to claim 1 wherein said cylindrical portion is formed with a small opening therein, and an end of said tear strip extends through said opening to form a holding flap.

3. A seal according to claim 2 wherein said strip extends around the entire inner periphery of said container so that the holding flap end of said strip overlaps the other end thereof.

4. A seal according to claim 2 wherein said opening is sealed with a plastic sealing compound.

5. A seal according to claim 2 wherein said opening is sealed with a piece of foil adhered thereon.

6. A seal according to claim 1 wherein said membrane extends over the edge of the open end of said container to form a protective cover for the container edge.

7. A seal according to claim 1 wherein said strip is adhered to said cylindrical portion of said membrane.

8. A seal according to claim 1 wherein said membrane is heat sealed to said container and said tear strip is formed from a material which is resistant to deformation at the heat sealing temperature.

9. A seal according to claim 1 wherein said tear strip is reinforced with glass fibers.

10. An improved pilfer-proof membrane seal for a container of the type having a replaceable lid insertable into the container opening, the seal comprising a membrane having a cylindrical portion extending downwardly into the open end of the container at least to the insertion depth of the lid, said cylindrical portion lying adjacent the inner surface of the container and being at least partly sealed to said inner surface, and a transverse portion extending across the interior of said container to close the interior volume thereof below said insertion depth; and a tear strip extending around the inner surface of said cylindrical portion, said tear strip being firmly adhered to said inner surface.

* * * * *